United States Patent [19]

Hardcastle

[11] Patent Number: 4,871,322

[45] Date of Patent: Oct. 3, 1989

[54] CONNECTOR

[76] Inventor: Robert E. Hardcastle, 2019 Sandydale, Houston, Tex. 77039

[21] Appl. No.: 211,251

[22] Filed: Jun. 24, 1988

[51] Int. Cl.[4] ..... H01R 13/00

[52] U.S. Cl. ..... 439/169

[58] Field of Search ..... 439/166, 169–171, 439/173–175, 692, 695

[56] References Cited

U.S. PATENT DOCUMENTS 2,779,930 1/1957 Archer ..... 439/692

FOREIGN PATENT DOCUMENTS 511887 10/1920 France ..... 439/171
187127 10/1922 United Kingdom ..... 439/171
262887 12/1926 United Kingdom ..... 439/171

*Primary Examiner*—Joseph H. McGlynn
*Attorney, Agent, or Firm*—Robert W. B. Dickerson

[57] ABSTRACT

An electrical connector for linking a clip to a base plug, the connector having a threaded portion for securing itself to the base plug, and also having a laterally positioned, flattened segment to be grasped by the clip.

5 Claims, 1 Drawing Sheet

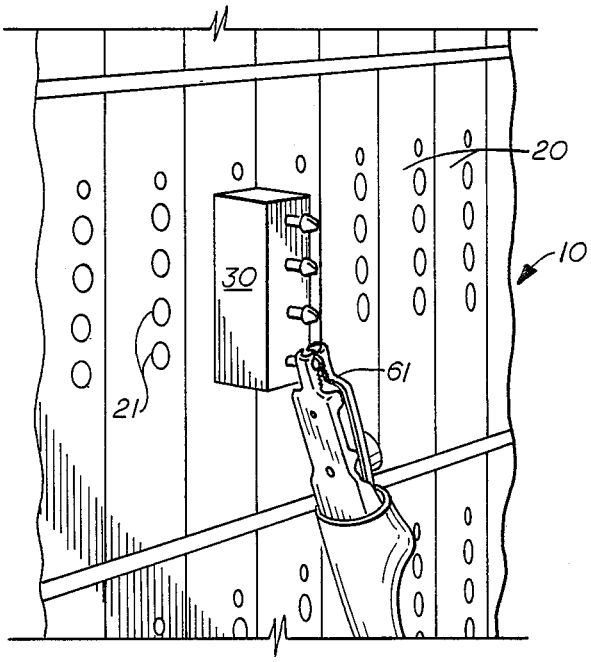
FIG. 1
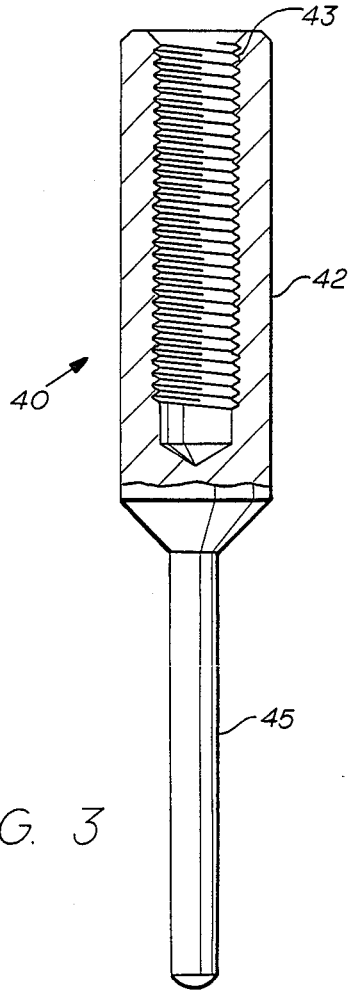
FIG. 3
FIG. 2
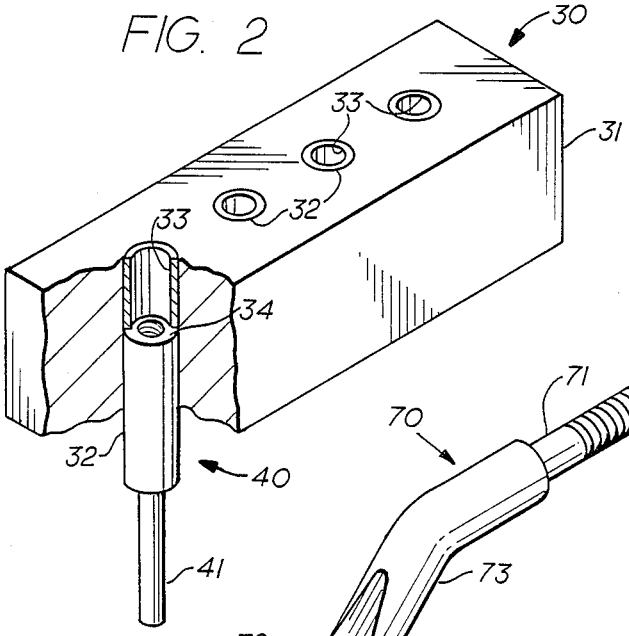
FIG. 4
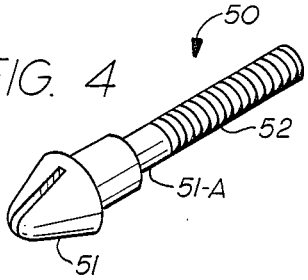
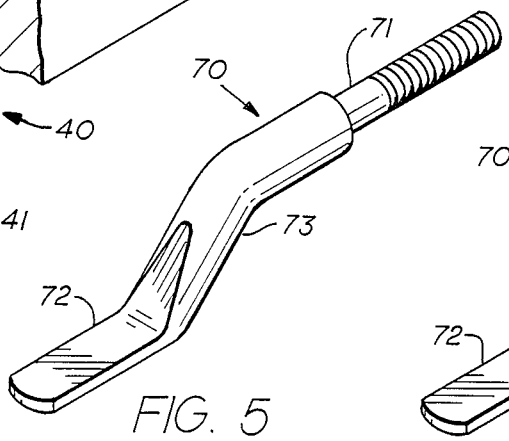
FIG. 5
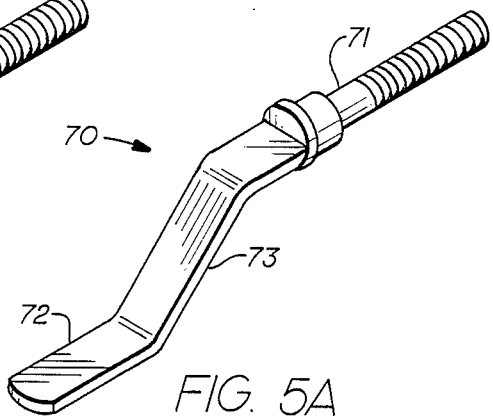
FIG. 5A

CONNECTOR

BACKGROUND OF THE INVENTION

Modern day telephone technology, especially as used in large metropolitan areas, includes large numbers of dispersed, control apparatus. Such remote terminal units, such as SLC 96 Channel Systems used by Southwestern Bell Telephone Company, must periodically be tested for repair or for preventive maintenance purposes. Pin-Plug carrying blocks are removably plugged into apertures contained by the control apparatus, and test equipment establishes electrical communication with the internal circuitry of said apparatus there through. The linkage between the test equipment and the movable blocks has in itself caused harm to the control apparatus. An important source of such harm has been the unstable means of securing test equipment clips to the pin portion of a plug carried by said blocks. This invention attacks the problem by substantially varying the configuration of the block's pins.

SUMMARY OF THE INVENTION

The old pin-head portion of a plug has been modified so as to include a tang or grasping portion. Such tang is laterally displaced from the axis of the pin. Thus a test clip may easily and securely clamp thereto.

DESCRIPTION OF THE DRAWINGS

FIG. 1 is a partial perspective of a unit of control apparatus for a telephone system;

FIG. 2 is a broken perspective of a removably insertable block showing the base portion of a plug positioned in one aperture thereof;

FIG. 3 is a vertical, axial section through the base portion of the plug of FIG. 2;

FIG. 4 is a perspective of the pin portion of a connector constituting the prior art; and FIG. 5 and 5A are embodiments of the modified connector of this invention.

DESCRIPTION OF A PREFERRED EMBODIMENT

FIG. 1 illustrates an item of telephone control apparatus 10, in this instance an SLC 96 Channel System. Such system includes, in addition to sophisticated electronic circuitry, not illustrated, a number of modular panel 20, each having a plurality of apertures 21 therethrough. FIG. 2 more clearly illustrates a removably insertable block 30. Such block includes an elongated housing 31. A plurality of aligned bores 32 extend laterally therethrough. Cylindical bearing members 33 are fitted within such bores and extend through approximately one half of their length, passageways being formed by the I.D. of bearing members 33 and the adjacent I.D. through the remainder of communicating bores 32.

Plug base 40, see FIGS. 2 and 3, includes stem or nipple portion 41 axially depending from enlarged, cylindical, seat 42. Said seat portion rests against a shoulder formed by the end 34 of bearing 33. The I.D. of said seat formed by bore 43, is internally threaded.

Until now Applicant's invention has not come into play. The prior art connector was, and is, a plug pin 50, having a slotted head 51 and axially depending stem 51-A. Such stem was externally threaded at 52, so as to be threadedly engageable with the internal threads of bore 43 of the plug base 40, Head 51 was of conical configuration, with a smooth, continuously curving outer face. During testing, when the jaws 61 of a test clip clamped head 51 therebetween, such round outer face of the head permitted the test clip to easily slip. Often time this has resulted in conductive portions of adjacent clips contacting, with resultant short circuits.

Consider now applicant's improvements. Connector 70 (see FIGS. 5 and 5*a*) takes the place of prior art plug pin 50. Said connector 70, like member 50, includes a depending, male threaded stem 71, for mating with internally threaded bore 43 of plug base 40. Flattened tang or clip 72 is laterally offset from the axis of stem 71, and connected thereto by neck 73. Said neck may have differing configurations, such as tubular in FIG. 5 or flattened in FIG. 5-A. It may take sharp or gently curved bends.

In operation, one or more plug bases 40 would have their seats 42 inserted within respective bores 32 of block housing 31, so that the base ends would abut bearing ends 34. Then an equivalent number of connectors 70 would each have its threaded stem 71 inserted through a bearing 33, to threadedly engage the threaded bore 43 of plug base 40. Stem or pin portions 41 would then be inserted through apertures 21 in apparatus panels 20, to establish contact with circuitry internal thereof. Testing equipment, meters or the like, would be in electrical contact with pin or stem 41, by virtue of its test clip jaws 61 clamping flattened tang 72. It is at this stage, and during the assembly of members 70 and 40 onto block 30, that the advantages of this invention become apparent. The flat clamping surface of tang 72 permits jaws 61 to securely fasten test clip 60 thereto, without the danger of rotation. During assembly and disassembly, the offset positioning of tang 72 by neck 73 provides a lever effect permitting tang 72 to function as a rotatable handle.

Although limited embodiments have been depicted or described, it should be obvious that numerous modifications would be possible by one skilled in the art without departing from the spirit of the invention, the scope of which is limited only by the following claims.

I claim:

1. An improved electrical connector for use with a clip, comprising:

an externally threaded stem;

clip jaws receiving means having opposed flattened surfaces; neck means linking said stem to said clip jaws receiving means in a laterally offset relationship, said neck means having an obtuse angled relationship to each of said stem and said receiving means.

2. The connector of claim 1 wherein said neck means is cylindical in configuration throughout a substantial portion of its length.

3. The connector of claim 1 wherein said receiving means is similar in cross section to said neck means.

4. In a block device for establishing electrical communication between the clip jaws of test apparatus and the electricl circuitry of telephonic control apparatus, wherein said block device includes housing means having a plurality of passageways therethrough; a female-threaded, control apparatus-engaging plug fitted at least partially within at least one of said passageways; and test apparatus engaging portion, the improvement comprising: said test apparatus engaging portion including a male threaded stem a laterally displaced clip-jaws engaging portion having opposed flattened surfaces, and neck means linking said stem to said clip jaws engaging portion.

5. The device of claim 4 wherein said neck member is cylindical in configuration throughout a substantial portion of its length.

* * * * *